US007564026B2

(12) United States Patent
Vestal

(10) Patent No.: US 7,564,026 B2
(45) Date of Patent: Jul. 21, 2009

(54) LINEAR TOF GEOMETRY FOR HIGH SENSITIVITY AT HIGH MASS

(75) Inventor: Marvin L. Vestal, Framinghan, MA (US)

(73) Assignee: Virgin Instruments Corporation, Sudbury, MA (US)

( * ) Notice: Subject to any disclaimer, the term of this patent is extended or adjusted under 35 U.S.C. 154(b) by 308 days.

(21) Appl. No.: 11/742,685

(22) Filed: May 1, 2007

(65) Prior Publication Data

US 2008/0272289 A1 Nov. 6, 2008

(51) Int. Cl.
*H01J 49/40* (2006.01)

(52) U.S. Cl. ..... 250/287

(58) Field of Classification Search ..... 250/281, 250/282, 287

See application file for complete search history.

(56) References Cited

U.S. PATENT DOCUMENTS 4,730,111 A 3/1988 Vestal et al.
4,731,533 A 3/1988 Vestal
4,766,312 A 8/1988 Fergusson et al.
4,814,612 A 3/1989 Vestal et al.
4,861,989 A 8/1989 Vestal et al.
4,883,958 A 11/1989 Vestal
4,902,891 A 2/1990 Vestal
4,958,529 A 9/1990 Vestal
4,960,992 A 10/1990 Vestal et al.
5,015,845 A 5/1991 Allen et al.
5,160,840 A 11/1992 Vestal
5,498,545 A 3/1996 Vestal
5,614,711 A * 3/1997 Li et al. ..... 250/287
5,625,184 A 4/1997 Vestal et al.
5,627,369 A 5/1997 Vestal et al.
5,760,393 A 6/1998 Vestal et al.
6,002,127 A 12/1999 Vestal et al.

(Continued)

FOREIGN PATENT DOCUMENTS

GB 2 370 114 6/2002

(Continued)

OTHER PUBLICATIONS

R. Kaufmann, et al., "Sequencing of Peptides in a Time-of-Flight Mass Spectrometer-Evaluation of Postsource Decay . . . ," Int. J. Mass Spectrom. Ion Process. 131: 355-385 (1994).

(Continued)

*Primary Examiner*—Jack I Berman
(74) *Attorney, Agent, or Firm*—Kurt Rauschenbach; Rauschenbach Patent Law Group, LLC

(57) ABSTRACT

The present invention provides a time-of-flight (TOF) mass analyzer. The system includes an analyzer vacuum housing isolated from the evacuated ion source vacuum housing by a gate valve maintained at ground potential. A pulsed ion source is located within the ion source housing, and the gate valve is located in a first field-free region at ground potential. A second field-free drift space within the analyzer housing is biased at high voltage with opposite polarity to the voltage applied to the pulsed ion source. Novel ion detectors are provided with input surfaces in electrical contact with the second field-free drift space with output connected to an external digitizer at ground potential.

18 Claims, 8 Drawing Sheets

U.S. PATENT DOCUMENTS

| | | | | |
|---|---|---|---|---|
| 6,057,543 | A | 5/2000 | Vestal et al. | |
| 6,175,112 | B1 | 1/2001 | Karger et al. | |
| 6,281,493 | B1 | 8/2001 | Vestal et al. | |
| RE37,485 | E | 12/2001 | Vestal | |
| 6,348,688 | B1 | 2/2002 | Vestal | |
| 6,414,306 | B1 | 7/2002 | Mayer-Posner et al. | |
| 6,441,369 | B1 * | 8/2002 | Vestal et al. | 250/287 |
| 6,504,150 | B1 | 1/2003 | Verentchikov et al. | |
| 6,512,225 | B2 | 1/2003 | Vestal et al. | |
| 6,534,764 | B1 | 3/2003 | Verentchikov et al. | |
| 6,541,765 | B1 | 4/2003 | Vestal | |
| 6,621,074 | B1 | 9/2003 | Vestal | |
| 6,670,609 | B2 | 12/2003 | Franzen et al. | |
| 6,674,070 | B2 | 1/2004 | Karger et al. | |
| 6,770,870 | B2 | 8/2004 | Vestal | |
| 6,825,463 | B2 | 11/2004 | Karger et al. | |
| 6,831,270 | B2 | 12/2004 | Furuta et al. | |
| 6,844,545 | B1 | 1/2005 | Hutchins et al. | |
| 6,900,061 | B2 | 5/2005 | Smirnov et al. | |
| 6,906,317 | B2 * | 6/2005 | Bateman et al. | 250/281 |
| 6,918,309 | B2 | 7/2005 | Brock et al. | |
| 6,933,497 | B2 | 8/2005 | Vestal | |
| 6,952,011 | B2 | 10/2005 | Brown et al. | |
| 6,953,928 | B2 | 10/2005 | Vestal et al. | |
| 6,995,363 | B2 | 2/2006 | Donegan et al. | |
| 7,030,373 | B2 | 4/2006 | Vestal et al. | |
| 7,064,319 | B2 | 6/2006 | Hashimoto et al. | |
| 7,109,480 | B2 | 9/2006 | Vestal et al. | |
| RE39,353 | E | 10/2006 | Vestal | |
| 7,176,454 | B2 | 2/2007 | Hayden et al. | |
| 2003/0057368 | A1 | 3/2003 | Franzen et al. | |
| 2003/0116707 | A1 | 6/2003 | Brown et al. | |
| 2005/0031496 | A1 | 2/2005 | Laurell et al. | |
| 2005/0087685 | A1 | 4/2005 | Bouvier et al. | |
| 2005/0130222 | A1 | 6/2005 | Lee | |
| 2005/0178959 | A1 | 8/2005 | Lopez-Avila et al. | |
| 2006/0266941 | A1 | 11/2006 | Vestal | |
| 2006/0273252 | A1 | 12/2006 | Hayden et al. | |
| 2007/0038387 | A1 | 2/2007 | Chen et al. | |
| 2007/0054416 | A1 | 3/2007 | Regnier et al. | |
| 2008/0272291 | A1 * | 11/2008 | Vestal | 250/287 |

FOREIGN PATENT DOCUMENTS

| | | | |
|---|---|---|---|
| WO | WO 2004/018102 | A1 | 3/2004 |
| WO | WO 2005/061111 | A2 | 7/2005 |

OTHER PUBLICATIONS

J. Preisler, et al., "Capillary Array Electrophoresis-MALDI Mass Spectrometry using a Vacuum Deposition Interface," Anal. Chem. 74: 17-25 (2002).

R. L. Caldwell and R. M. Caprioli, "Tissue Profiling by Mass Spectrometry," MCP 4: 394-401 (2005).

M. L. Vestal, et al., "Delayed Extraction Matrix-Assisted Laser Desorption Time-of-Flight Mass Spectrometry," Rapid Comm. Mass Spectrom. 9: 1044-1050 (1995).

M. L. Vestal and P. Juhasz, "Resolution and Mass Accuracy in Matrix-Assisted Laser Desorption Time-of-Flight Mass Spectrometry," J. Am. Soc. Mass Spectrom. 9: 892-911 (1998).

E. J. Takach, et al., "Accurate Mass Measurement using MALDI-TOF with Delayed Extraction," J. Prot. Chem. 16: 363-369 (1997).

D. J. Beussman, et al., "Tandem Reflectron Time-of-Flight Mass Spectrometer Utilizing Photodissociation," Anal. Chem. 67: 3952-3957 (1995).

M. L. Vestal, "High-Performance Liquid Chromatography-Mass Spectrometry," Science 226: 275-281 (1984).

* cited by examiner

LINEAR TOF GEOMETRY FOR HIGH SENSITIVITY AT HIGH MASS

BACKGROUND OF THE INVENTION

Matrix assisted laser desorption/ionization time-of-fight mass (MALDI-TOF) spectrometry is an established technique for analyzing a variety of nonvolatile molecules including proteins, peptides, oligonucleotides, lipids, glycans, and other molecules of biological importance. While this technology has been applied to many applications, widespread acceptance has been limited by many factors including cost and complexity of the instruments, relatively poor reliability, and insufficient performance in terms of speed, sensitivity, resolution, and mass accuracy.

In the art, different types of TOF analyzers are required depending on the properties of the molecules to be analyzed. For example, a simple linear analyzer is preferred for analyzing high mass ions such as intact proteins, oligonucleotides, and large glycans, while a reflecting analyzer is required to achieve sufficient resolving power and mass accuracy for analyzing peptides and small molecules. Determination of molecular structure by MS-MS techniques requires yet another analyzer. In some commercial instruments all of these types of analyzers are combined in a single instrument. This has the benefit of reducing the cost somewhat relative to three separate instruments, but the downside is a substantial increase in complexity, reduction in reliability, and compromises are required that make the performance of all of the analyzers less than optimal.

Many areas of science require accurate determination of the molecular masses and relative intensities of a variety of molecules in complex mixtures and while many types of mass spectrometers are known in the art, each has well-known advantages and disadvantages for particular types of measurements. Time-of-flight (TOF) with reflecting analyzers provides excellent resolving power, mass accuracy, and sensitivity at lower masses (up to 5-10 kda), but performance is poor at higher masses primarily because of substantial fragmentation of ions in flight. At higher masses, simple linear TOF analyzers provide satisfactory sensitivity, but resolving power is limited. An important advantage of TOF MS is that essentially all of the ions produced are detected, unlike scanning MS instruments.

Applications such as tissue imaging and biomarker discovery require measurements on intact proteins over a very broad mass range. For these applications, mass range, sensitivity over a broad mass range, speed of analysis, reliability, and ease-of-use are more important than resolving power. The present invention seeks to address these issues in providing a mass spectrometer having optimum performance that is reliable, easy to use, and relatively inexpensive.

SUMMARY OF THE INVENTION

The mass spectrometer according to one embodiment of the invention comprises a pulsed ion source, a first field-free space at ground potential to receive ions from the pulsed ion source, a second field-free space isolated from ground potential to receive ions from the first field-free space, and an ion detector having an input surface in electrical contact with the second field-free space at the end distal from the first field-free space. One embodiment further comprises a MALDI sample plate within the pulsed ion source, a pulsed laser beam directed to strike the MALDI sample plate and produce a pulse of ions, a high voltage pulse generator operably connected to the pulsed ion source, a time delay generator providing a predetermined time delay between the laser pulse and the high voltage pulse, and a high voltage supply providing substantially constant voltage to the second field-free drift space of opposite polarity to that of the high voltage pulse generator; One embodiment further comprises an extraction electrode within the pulsed ion source and an external constant high-voltage supply connected to the extraction electrode and the MALDI sample plate. In this embodiment the high voltage pulse generator is capacitively coupled to the MALDI sample plate. In one embodiment the uncertainty in the predetermined time delay is not more than 1 nanosecond.

The mass spectrometer according to another embodiment of the invention comprises a MALDI sample plate and pulsed ion source located in a source vacuum housing; an analyzer vacuum housing isolated from the source vacuum housing by a gate valve containing an aperture and maintained at ground potential; a vacuum generator that maintains high vacuum in the analyzer; a pulsed laser beam that enters the source housing through the aperture in the gate valve when the valve is open and strikes the surface of a sample plate within the source producing ions that enter the analyzer through the aperture; an electrically isolated drift tube aligned with the ion beam and biased at high voltage by connection to an external high voltage supply; an ion focusing lens located between the gate valve and the drift tube; and an ion detector mounted with one surface in electrical contact with the distal end of the drift tube, A high voltage pulse generator supplies a voltage pulse opposite in polarity to the voltage on the isolated drift tube to the MALDI sample plate, and the time between the voltage pulse and the time that ions are detected at the detector is recorded by a digitizer to produce a time-of-flight spectrum that may be interpreted as a mass spectrum by techniques well known in the art.

An object of the invention is to provide the optimum practical performance within limitations imposed by the length of the analyzer, the accelerating voltage, and the initial conditions including the width of the initial velocity distribution of the ions produced by MALDI and the uncertainty in initial position due, for example, due to the size of the matrix crystals. In TOF mass spectrometry the performance can generally be improved by increasing the length of the analyzer and, for higher masses, by increasing the accelerating voltage, but these tend to increase the cost and reduce the reliability. The initial conditions are determined by the ionization process and are independent of the TOF analyzer design.

One embodiment of the invention is designed to give very high performance for high mass positive ions. In this embodiment the amplitude of the high voltage pulse is +10 kV and the voltage applied to the isolated drift tube is −30 kV. In this embodiment of the invention the total accelerating voltage is 40 kilovolts, and the effective length of the analyzer is 1300 mm. In this embodiment the detector comprises a dual channel plate assembly mounted with the input surface in electrical contact with the drift tube as −30 kV and the anode is connected to ground potential through a fifty ohm resistor. In this embodiment of the invention the bias voltage supplied to the dual channel plate electron multiplier is provided by a voltage divider connected between the −30 kV high voltage supply and ground and the bias voltage across the dual channel plate assembly is adjusted by adjusting the resistance of the portion of the voltage divider near ground potential to provide bias voltage to the electron multiplier that is between 1.6 and 2 kilovolts more positive that the potential supplied to the drift tube.

One embodiment further comprises one or more ion lenses for spatially focusing the ion beam. One embodiment comprises a first ion lens located between the pulsed ion source and the gate valve and a second ion lens located between the gate valve and the second field-free drift tube. In one embodiment the focusing element of the second ion lens is at ground potential. In one embodiment the first ion lens constitutes either a cathode lens or an einzel lens, and the second ion lens constitutes either a cathode lens or an einzel lens.

In one embodiment deflector electrodes are provided in a field-free region adjacent to the extraction electrode and energized to deflect ions in either of two orthogonal directions. At least one of the deflector electrodes may be energized by a time dependent voltage that causes ions in one or more selected mass ranges to be deflected away from the detector.

One embodiment of the invention is designed to give very high performance for high mass ions of either polarity. In this embodiment the amplitude of the high voltage pulse is 10 kV and of the same polarity as the ions to be analyzed, and the voltage applied to the isolated drift tube is 30 kV and of opposite polarity. In this embodiment of the invention the total accelerating voltage is 40 kilovolts, and the effective length of the analyzer is 1300 mm. In this embodiment the detector comprises a novel conversion dynode electrically connected to the isolated drift tube and a conventional electron multiplier assembly mounted at ground potential. High energy ions of either polarity impacting the conversion dynode produce secondary ions of both polarities. The conversion dynode uses a novel grid structure that is opaque to high energy ions striking the input surface, but has openings that allow the secondary ions of sign opposite the charge on the high energy ions to be transmitted, accelerated by the high electrical field between the drift tube and 30 kV, and detected by the electron multiplier at ground potential.

In one embodiment is provided a time-of-flight mass spectrometer comprising a pulsed ion source; a first field-free drift space substantially at ground potential to receive ions from the pulsed ion source; a second field-free drift space isolated from ground potential to receive ions from the first field-free drift space; and an ion detector having an input surface in electrical contact with the second field field-free drift space at the end distal from the first field-free drift space and having an output surface at ground potential.

The time-of-flight mass spectrometer of the present invention may further comprise a MALDI sample plate within the pulsed ion source; a pulsed laser beam directed to strike the MALDI sample plate and produce a pulse of ions; a high voltage pulse generator operably connected to the pulsed ion source; a time delay generator providing a predetermined time delay between the laser pulse and the high voltage pulse; and a high voltage supply providing substantially constant voltage to the second field-free drift space of opposite polarity to that of the high voltage pulse generator.

In one embodiment, the time-of-flight mass spectrometer of the present invention has a predetermined time delay comprising an uncertainty of not more than 1 nanosecond.

In one embodiment, the time-of-flight mass spectrometer of the present invention has a high voltage pulse with an amplitude of 10 kilovolts positive relative to ground potential and high voltage supplied to the second field-free drift space of 30 kilovolts negative relative to ground potential.

In one embodiment, the time-of-flight mass spectrometer of the present invention has a high voltage pulse with an amplitude of 10 kilovolts negative relative to ground potential and high voltage supplied to the second field-free drift space of 30 kilovolts positive relative to ground potential.

In one embodiment, the high voltage pulse is capacitively coupled to either the MALDI sample plate or the extraction plate to accelerate ions of a predetermined polarity.

In one embodiment, the time-of-flight mass spectrometer of the present invention comprises an ion source vacuum housing configured to receive a MALDI sample plate; a pulsed ion source located within the ion source housing; an analyzer vacuum housing; a gate valve located between and operably connecting said ion source vacuum housing and said analyzer vacuum housing and maintained at or near ground potential; a first field-free drift tube at or near ground potential located within said ion source vacuum housing to receive an ion beam from said pulsed ion source; a second field-free drift tube located within said analyzer vacuum housing but electrically isolated from said housing to receive an ion beam from said first field-free drift tube; and an ion detector having an input surface in electrical contact with the second field field-free drift space at the end distal from said first field-free drift tube and having an output surface at ground potential. In this embodiment, the time-of-flight mass spectrometer may further comprise one or more pairs of deflection electrodes located in the field-free region at ground potential adjacent to the gate valve with any pair energized to deflect ions in either of two orthogonal directions. At least one of the deflection electrodes of any pair of deflection electrodes may be energized by a time-dependent voltage resulting in the deflection of ions in one or more selected mass ranges. This embodiment may also comprise one or more ion lenses for spatially focusing the ion beam and these ion lenses may comprise a first ion lens located between the pulsed ion source and the gate valve; and a second ion lens located between the gate valve and the second field-free drift tube. Each of the ion lenses may comprise either an einzel lens or a cathode lens.

Detectors used in the present invention may comprise an input surface that produces secondary ions and an electron multiplier at substantially ground potential that detects secondary ions after acceleration from the second field-free drift space. Detectors used herein may comprise dual channel plate assembly with an input surface in electrical contact with the second field-free drift space and an anode at ground potential. The potential difference across the channel plate assembly may be provided by a voltage divider between the potential applied to the second field-free drift space and ground and may be controlled by adjusting the resistance of the portion of the voltage divider near the grounded terminal.

In one embodiment, the time-of-flight mass spectrometer of the present invention further comprises an extraction electrode located adjacent to the MALDI sample plate said extraction electrode having a predetermined constant voltage which is applied to an extraction plate and the MALDI sample plate.

In one embodiment the pulsed ion source of the time-of-flight mass spectrometer of the present invention operates at a frequency of at least 5 khz.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
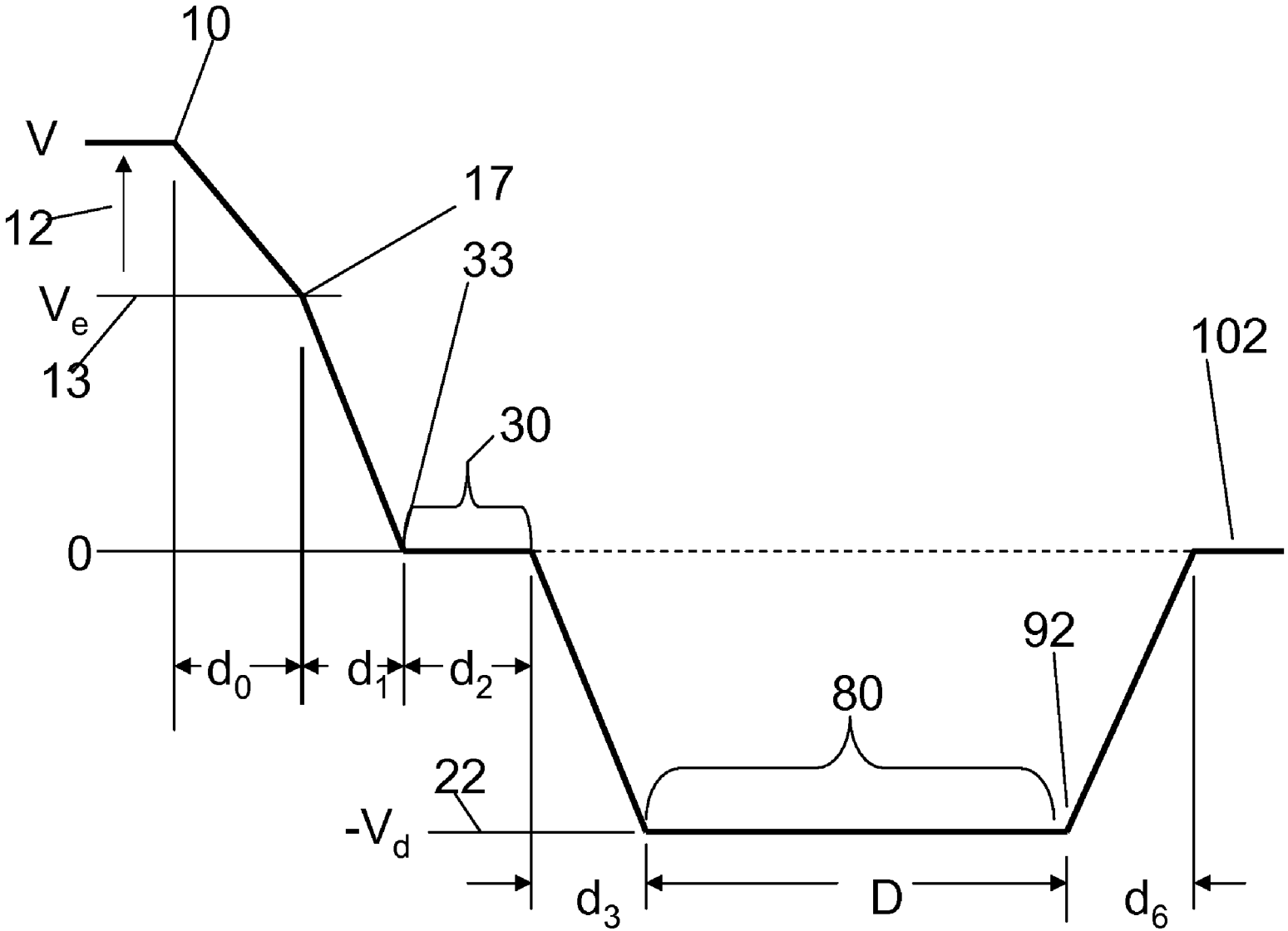
FIG. 1 is a potential diagram for a linear time-of-flight analyzer according to one embodiment of the invention.

Referring now to FIG. 1. The figure shows a potential diagram and critical dimensions for one embodiment of the invention. This embodiment comprises a pulsed ion source; a first field-free region or drift tube (or space) 30 at ground potential; a second field-free region or drift tube (or space) 80 isolated from ground potential; an ion detector 90 with input surface 92 electrically connected to drift tube (or space) 80 and output 102 at ground potential. The pulsed ion source comprises an extraction electrode 17 biased at potential $V_e$ 13 and a sample plate 10 initially biased at $V_e$ and pulsed to potential V by application of high voltage pulse 12.

Figure 2:
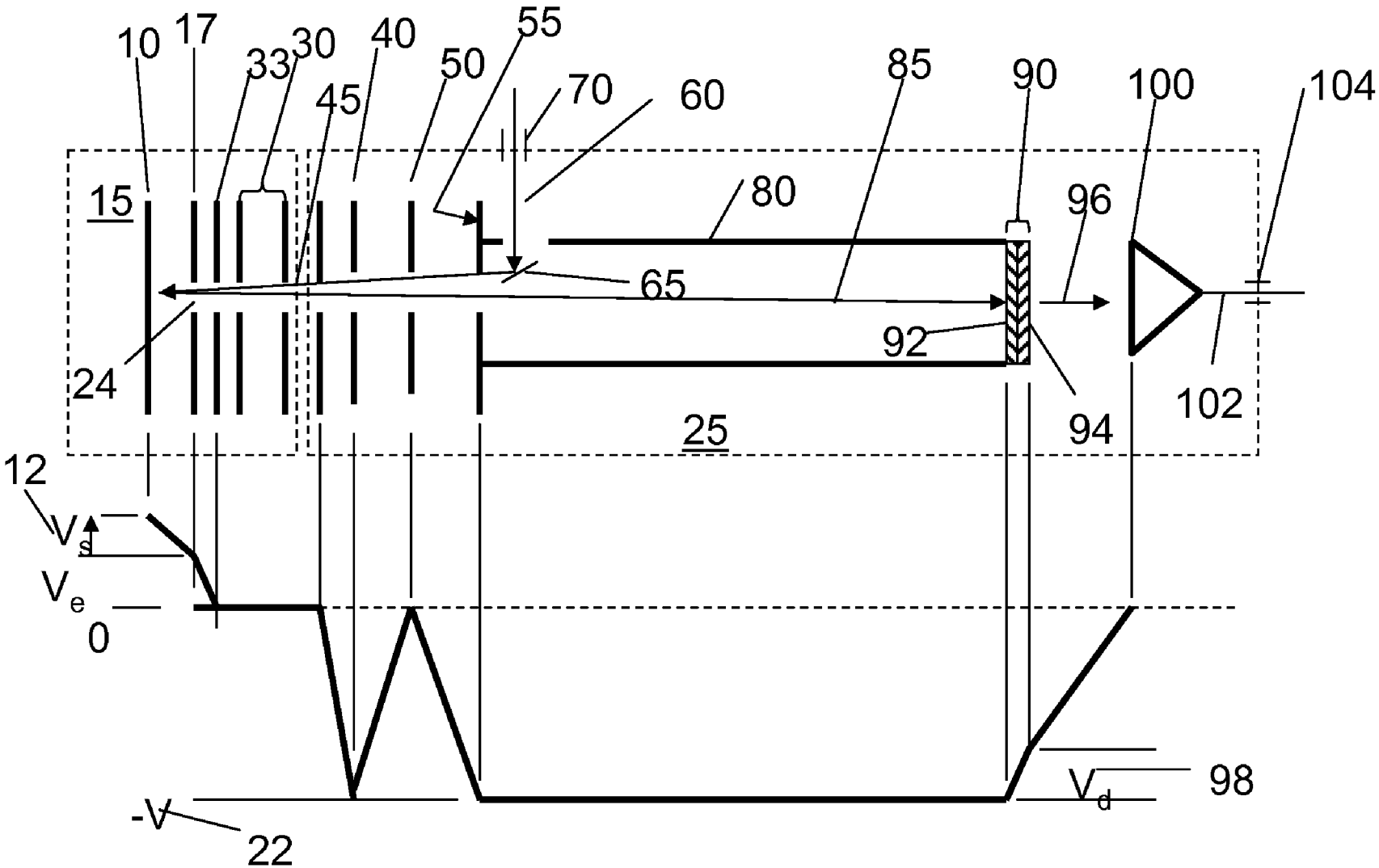
FIG. 2 is a schematic diagram of a linear time-of-flight analyzer according to another embodiment of the invention.

Referring now to FIG. 2. The figure shows an embodiment of the mass spectrometer of the invention. Shown below the apparatus configuration is a potential diagram noting the position of potentials at various positions in the apparatus. According to the present invention, a MALDI sample plate 10 with samples of interest in matrix crystals on the surface is installed within an evacuated ion source housing 15 and a sample of interest is placed in the path of pulsed laser beam 60. As used herein, a "MALDI sample plate" or "sample plate" refers to the structure onto which the samples are deposited. Such sample plates are disclosed and described in copending U.S. application Ser. No. 11/541,467 filed Sep. 29, 2006, the entire disclosure of which is incorporated herein by reference. The laser pulse enters the analyzer vacuum housing 25 via a window 70 in the housing and is reflected by a mirror 65. At a time following the laser pulse a high-voltage pulse 12 is applied to the sample plate 10 producing an electric field between sample plate 10 and extraction electrode 17 causing a pulse of ions to be accelerated. The ions pass through aperture 24 in the extraction electrode 17 and through a first field-free region 30 and gate valve 45 in the open position, and into analyzer vacuum housing 25. Ions are further accelerated by potential −V 22 applied to an acceleration electrode 40, focused by potential applied to lens electrode 50 and are re-accelerated by potential −V 22 also applied to drift tube (or space) 80. In the figure, the combination of the acceleration electrode 40, the lens electrode 50 and the entrance surface 55 of the drift tube (or space) 80 form what is known in the art as an "einzel" lens. The ion beam 85 passes through the field-free drift tube 80 and strikes the input surface 92 of a detector 90. The detector comprises a dual channel plate electron multiplier. Each ion impinging on the input surface 92 produces a large number (ca. 1 million) of electrons in a narrow pulse at the outer surface 94 of the channel plate assembly. The gain of the detector is determined by the bias voltage $V_d$ 98 applied across the dual channel plate. The electrons are accelerated by the electric field, flow 96 between the outer surface 94 and the anode 100 at ground potential, and strike the anode producing an output pulse or signal 102 that is coupled through an electrical feedthrough 104 in the wall of the analyzer vacuum housing 25 and connected to the input of a digitizer (not shown).

The potential applied to lens electrode 50 can be adjusted to spatially focus ions at the detector. In one embodiment the dimensions of the lens are determined to provide optimal spatial focusing with the lens electrode 50 at ground potential.

Figure 3:
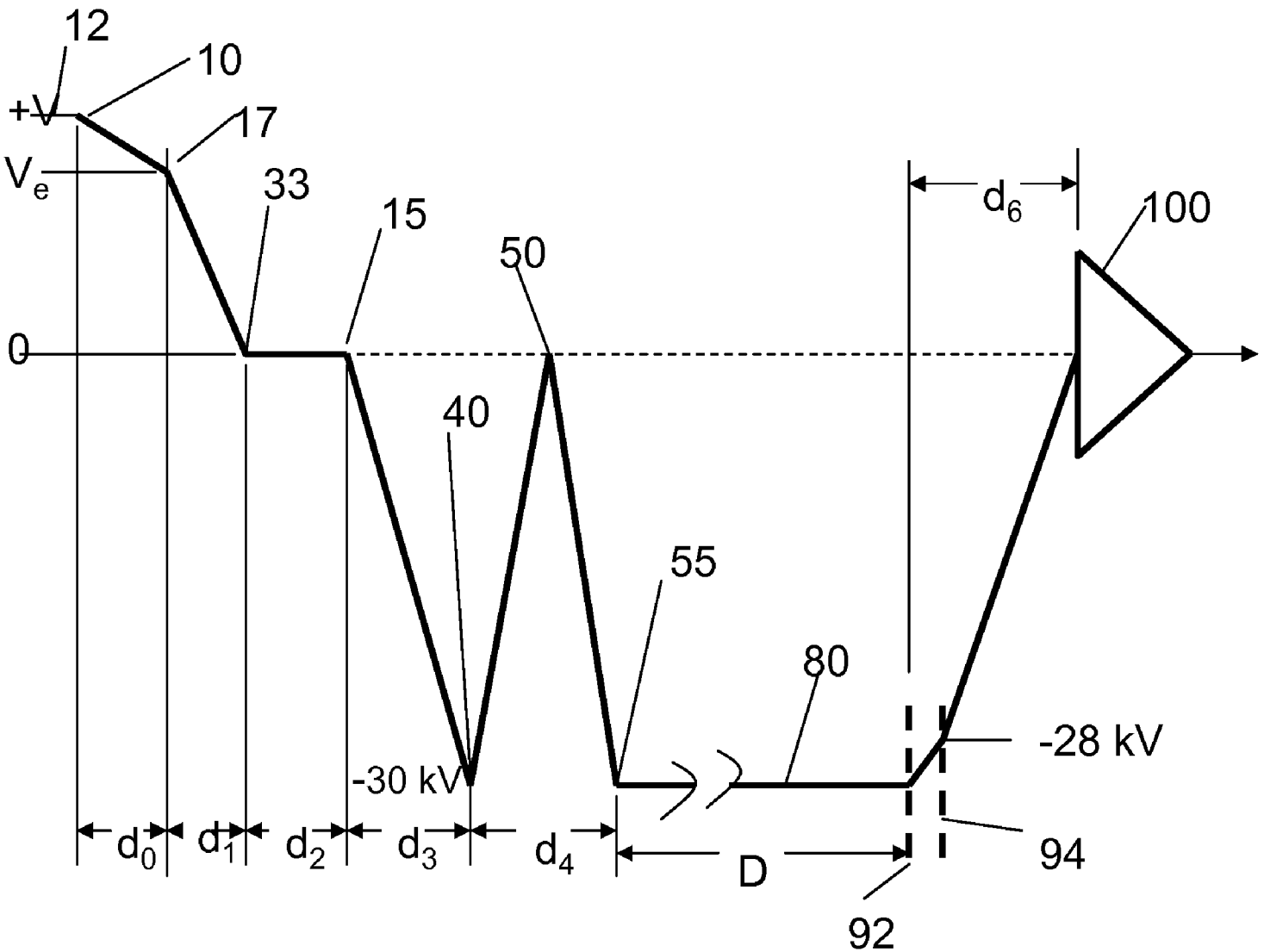
FIG. 3 is a representation of a potential diagram for one embodiment of the invention.

FIG. 3 represents a potential diagram for one embodiment of the invention. In this embodiment the potential applied to the acceleration electrode 40 and drift tube (or space) 80 is −30 kilovolts. The distances noted on the figure include the length of the first accelerating region between the MALDI sample plate 10 and the extraction electrode 17, $d_0$; the length of the second accelerating region between the extraction electrode 17 and the grounded electrode 33, $d_1$; the length of the first field-free region between the grounded electrode 33 and the evacuated ion source housing 15, $d_2$; the length of the third accelerating region between the evacuated ion source housing 15 and acceleration electrode 40, $d_3$; the length of the focusing lens between acceleration electrode 40 and drift tube entrance 55, $d_4$; the length of the second field-free region comprising the length of the drift tube measured between the drift tube entrance 55 and the input surface of the detector 92, D; and the distance between the input surface of the detector and the anode 100, $d_6$. The overall length of the analyzer is the sum of these distances plus any distance required to accommodate the evacuated ion source and analyzer vacuum housings.

The effective length, $D_e$, of a time-of-flight analyzer may be defined as the length of a field-free region for which the flight time of an ion with kinetic energy corresponding to that in the drift tube (or space) 80 is equal to that of the same ion in the actual machine being used, or real analyzer, including accelerating and decelerating fields. In one embodiment, the total effective length of the analyzer is between 0.5 m and 5 meters.

In one embodiment the effective length, $D_e$, is approximately 1300 mm and ion energy is 40 kV, corresponding to a high-voltage pulse 12 of 10 kV in amplitude applied to MALDI sample plate 10. In this embodiment the flight time is approximately $$t=(1300/0.0139)(m/V)^{1/2}=14{,}800m^{1/2} \quad (1)$$

where t is in nsec and m in kDa. For a repetition rate of 5 khz the maximum flight time is 200,000 nsec thus the maximum mass is 180 kDa starting from mass zero. Because the low mass region is dominated by ions from the MALDI matrix they are generally not useful for the analysis of samples. Also, if ions of masses higher than 180 kDa are produced, these will arrive following the next laser pulse and will be recorded at an incorrect mass. To solve this problem, in one embodiment an ion gate is provided that limits the mass range of ions exiting the ion source following each laser pulse so that only ions within a select or predetermined mass range are transmitted and detected.

Figure 4:
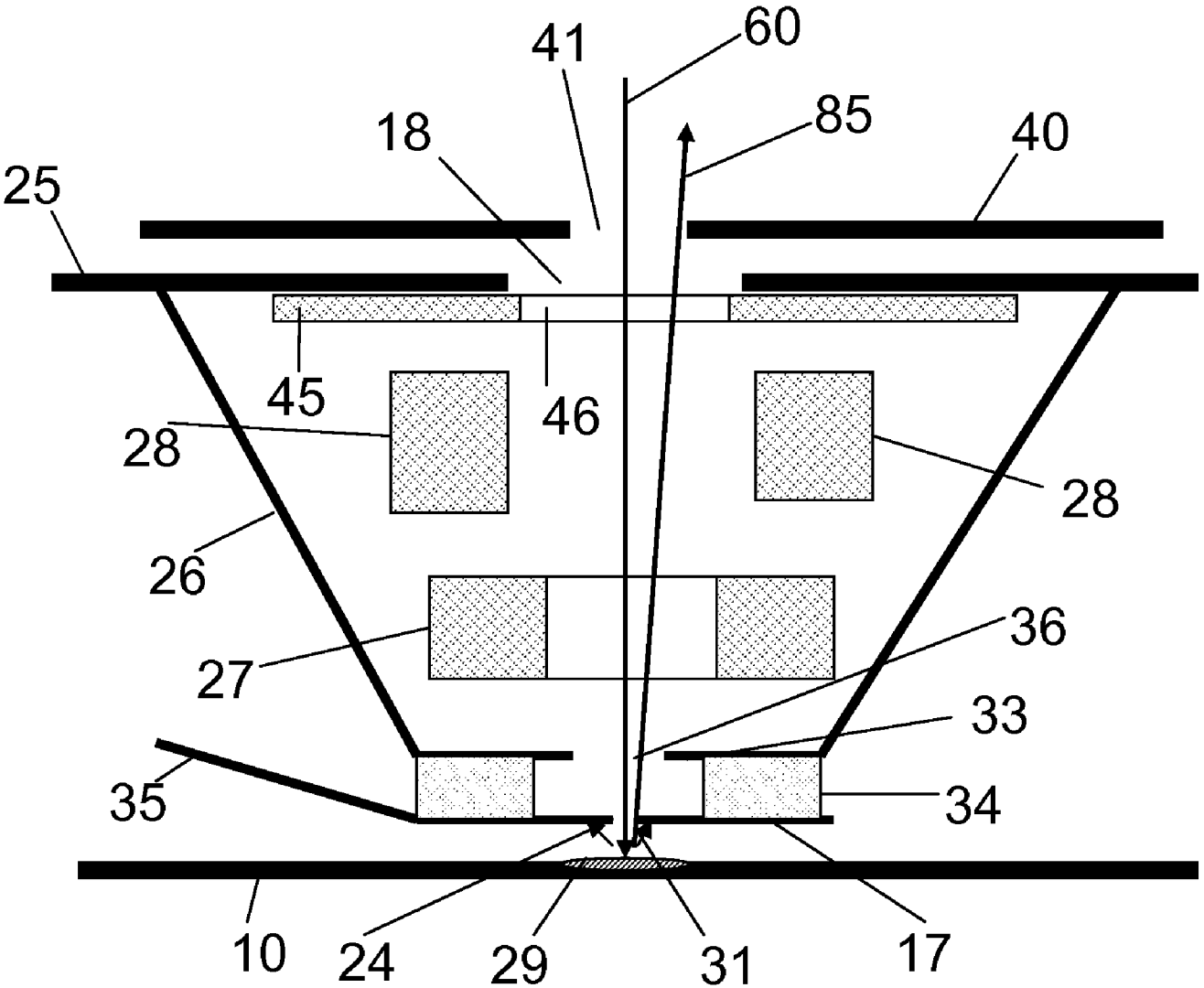
FIG. 4 is a cross-sectional schematic of an extraction electrode, gate valve, and ion optics in an embodiment with the extraction electrode isolated from ground potential.

FIG. 4 shows a partial cross-sectional detail of one embodiment of the invention comprising the first accelerating region between the MALDI sample plate 10 and the extraction electrode 17, the second accelerating region between the extraction electrode 17 and the grounded electrode 33, the first field-free region 30 between the grounded electrode 33 and the evacuated ion source housing 15, and the third accelerating region between the evacuated ion source housing 15 with differential pumping aperture 18 and acceleration electrode 40 with aperture 41. In one embodiment the first field-free region is enclosed in a grounded shroud or housing 26. It will be understood that while the evacuated ion source housing 15 and the analyzer vacuum housing 25 are separately labeled, they are in fact operably connected via the gate valve 45 with the sides of the two housings being functionally coincident.

Included within the field-free region are a gate valve 45, having an aperture 46, deflection electrodes 27 and 28. In the cross-sectional view 27 is below the plane of the drawing and a paired deflection electrode is above the plane of the drawing and hence is not shown. Voltage may be applied to one or more of the four deflection electrodes to deflect ions in the ion beam 85 produced by the pulsed laser beam 60 striking sample 29 deposited on the surface of the MALDI plate 10. A voltage difference between the paired deflection electrodes 27 deflects the ions in a direction perpendicular to the plane of the drawing, and a voltage difference between the pair of deflection electrodes 28 deflects ions in the plane of the drawing. Voltages can be applied as necessary to correct for misalignments in the ion optics and to direct ions along a preferred path to the detector. Also, a time dependent voltage can be applied to one or more of the deflection electrodes to deflect ions within predetermined mass ranges so that they cannot reach the detector and to allow ions in other predetermined mass ranges to pass through undeflected.

In some embodiments the extraction electrode 17 is insulated from grounded housing 26 by insulator 34 that supports the extraction electrode 17 and seals the extraction electrode to the grounded housing so that essentially all gas flow from the source housing into the analyzer housing passes through aperture 24 in extraction electrode 17. Plate or electrode 33 forms a portion of housing 26 with an aperture 36 that is sufficiently larger than aperture 24 that essentially none of the vaporized matrix in plume 31 that passes through aperture 30 strikes plate 33. An external high voltage supply (not shown) set to provide a predetermined constant voltage is connected through connection mean 35 to extraction electrode 17. The same external high voltage supply is connected to the high voltage pulse generator (not shown), and at a predetermined time following a laser pulse the high voltage pulse generator causes the voltage applied to sample plate 10 to switch from the predetermined voltage applied to the extraction grid to a second predetermined voltage causing ions produced by the laser pulse to be accelerated. This two-field ion source is preferred for applications requiring that ions be focused in time at a greater distance from the source than can readily be achieved using a single-field source.

The time required for an ion to travel from the ion source to a deflector following application of the high-voltage accelerating pulse to MALDI plate 10 is essentially proportional to the square root of the mass-to-charge ratio, and this time can be calculated with sufficient accuracy from a knowledge of the applied voltage V and the distances involved.

To transmit ions within a specified mass range, for example from $m_1$ to $m_2$, voltage is applied to the deflector at or before the laser pulse occurs and continues until the time that $m_1$ arrives at the entrance to the deflector, and is turned off until the time that $m_2$ exits the deflector. After $m_2$ exits the deflector, the voltage is turned back on. For example, mass ranges such as 3-230 kDa or 50-420 kDa can be acquired at 5 khz by using the mass gate to select a portion of the spectrum corresponding to arrival times at the detector within a 200 microsecond window corresponding to the time between laser pulses. As used herein a "mass gate" comprises the combination of the deflection electrodes and a time dependent pulse. Any ions outside the selected range are removed by the mass gate and the possibility of high masses overlapping into the spectrum produced by the next laser pulse is removed. The mass gate can also be employed to limit the mass range to a narrower window when required by the application.

The limit on resolving power set by time resolution is given by $$R_t^{-1}=t/2\Delta t \tag{2}$$

where Δt is the uncertainty of the time measurement. Since resolving power is less important than speed for many applications of this instrument, a relatively large bin size may be employed to limit the number of bins required to cover the mass range. As used herein "bin size" or "bin" refers to the channel width in the digitizer. For example, if the mass range to be measured covers the range from approximately 3 kDa to 230 kDa, then the time range is 200,000 nsec. Using 2 nsec bins this requires 100,000 bins and the maximum resolving power at the low mass end of the spectrum is about 1800 $m^{1/2}$ (m in kDa). Since the resolving power for this simple linear instrument is limited by other factors to be less than this value, use of 2 nsec bins does not limit the resolving power. For many purposes 4 nsec bins may be adequate and only 50,000 bins required.

In one embodiment, the MALDI sample plate 10 is pulsed up to 10 kV positive by the ion acceleration pulse. The ions are accelerated by an additional 30 kV by application of −30 kV to acceleration electrode 40 and isolated drift tube (or space) 80 containing an aperture aligned with the differential pumping aperture 18. The accelerating geometry and apertures are designed to focus the ions to the detector 90 located at the opposite end of the drift tube (or space). An einzel lens is provided and is fixed at ground potential. In one embodiment the detector 90 consists of a dual channel plate mounted directly to the drift tube with the output surface of the channel plate assembly 94 biased at 1.6 to 2 kV positive relative to the drift tube. The anode is connected to ground potential through a 50 ohm resistor and is spaced far enough (approximately 25 mm) from the channel plate to support the large voltage difference of approximately 28 kV. This novel detector arrangement (e.g., the support of such a large voltage difference and the attachment to ground using a resistor) is a preferred alternative to capacitive or inductive coupling of signal to ground from an anode at high potential as employed in the prior art.

Figure 5:
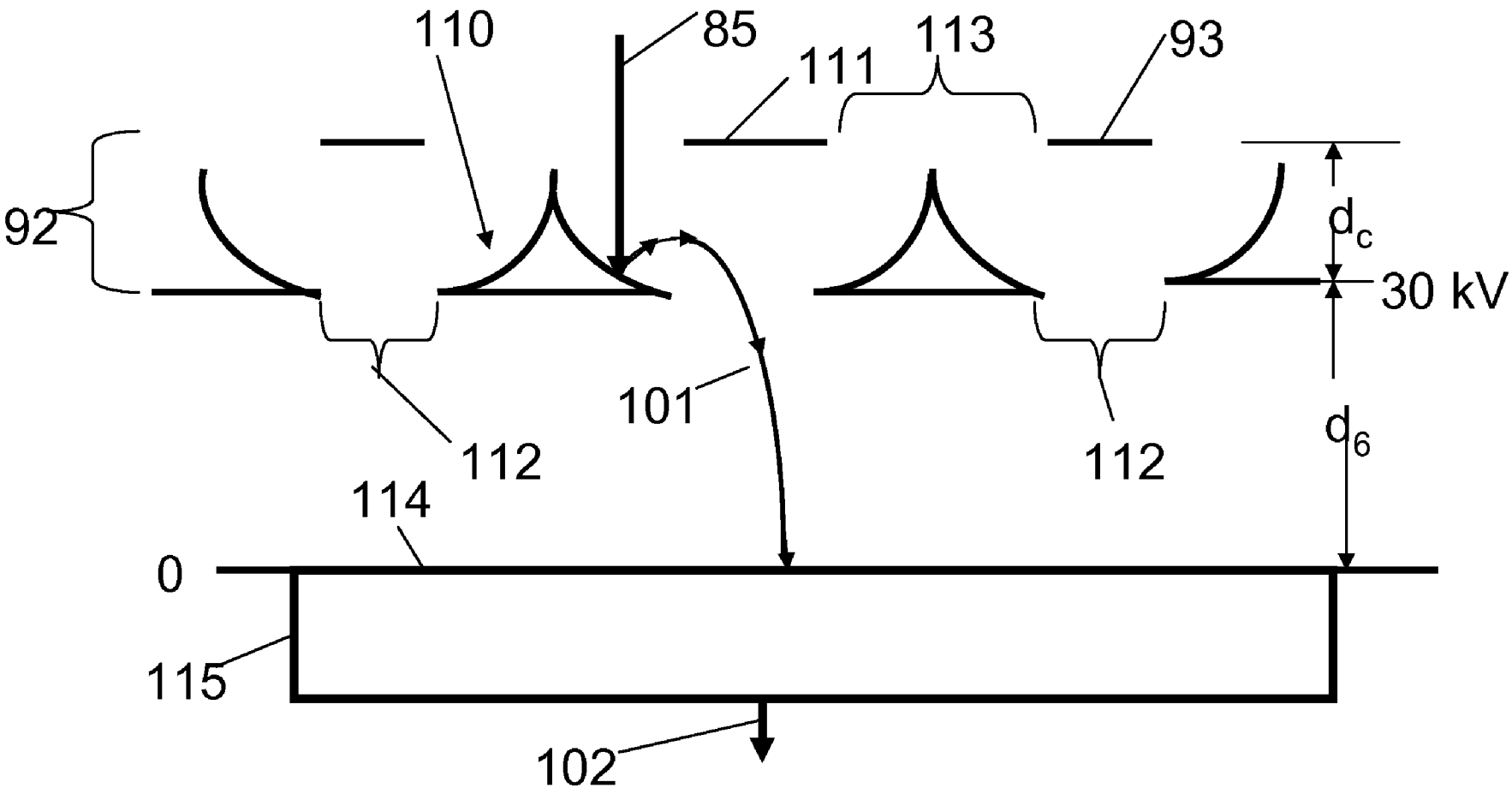
FIG. 5 is a schematic diagram of a detector comprising a conversion dynode electrically connected to the drift tube at high voltage and an electron multiplier at ground potential.

One embodiment of an alternative detector is illustrated schematically in FIG. 5. A partial cross section of the detector is illustrated. The input surface 92 having a thickness $d_c$ comprises a rectangular array of holes 112 and cusps 110 in a thin metal plate electrically connected to the drift tube (or space) 80. One embodiment comprises a 16×16 array with 1.15 mm spacing in a plate 0.5 mm thick. A second thin plate 93 comprises openings 113 aligned with the cusps 110 and circular stops 111 aligned with the holes 112 in the input surface 92. In one embodiment the thickness of the thin plate is 0.05 mm and the total area of the openings 113 is approximately 90% of the total area of the thin plate 93 within the 16×16 array. The combination of plate 93 and 92 is opaque to ions in ion beam 85 and at least 90% of the ions strike input surface 92 and no more than 10% strike surface 93. Electron multiplier surface 114 which receives ions in deflected ion beam 101 comprises the grounded front surface of a conventional electron multiplier. In one embodiment the potential applied to drift tube (or space) 80 is 30 kV and the distance $d_6$ is as small as practical without initiating an electrical discharge. In one embodiment $d_6$ is 20 mm. The polarity of the voltage applied to drift tube (or space) 80 is opposite to that of the ions in beam 85. The strong electrical field between surfaces 92 and 114 penetrates through the holes 112 and provides an electrical field at the surface of the cusps 110. Secondary ion opposite in polarity to that of ions in beam 85 are accelerated from the surface, extracted through holes 112 and strike the front surface 114 of electron multiplier 115. The pulse or signal output of the multiplier 102 is at ground potential and is coupled through a feedthrough to a digitizer (not shown) with 50 ohm input impedance. This detector is suitable for used with ions of either polarity and provides very high sensitivity for high mass ions since it is well known in the art that high mass ions, relative to low mass ions, are more efficient at producing secondary ions following impact on a surface rather than secondary electrons. However, this detector geometry introduces a substantial trajectory error, and in one embodiment this limits the resolving power to about 2000. This detector is preferred for sensitive detection of high mass ions and for negative ions, but the dual channel plate detector provides better performance for lower mass positive ions.

Design of TOF Analyzers

The principal measures of performance are sensitivity, mass accuracy, and resolving power. Sensitivity is the most difficult of these since it generally depends on a number of factors some of which are independent of the attributes of the analyzer. These include chemical noise associated with the matrix or impurities in the sample, and details of the sample preparation.

For the purpose of assessing the performance of the analyzer independent of these extraneous (although often dominant) factors the major components of sensitivity are the efficiency with which sample molecules are converted to ions providing measurable peaks in the mass spectrum, and the ion noise associated with ions detected that provide no useful information. The efficiency may be further divided into ionization efficiency (ions produced/molecule desorbed), transmission efficiency, and detection efficiency. A very important term that is often ignored is the sampling efficiency (sample molecules desorbed/molecule loaded).

The major sources of ion loss and ion noise are fragmentation and scattering. Fragmentation can occur spontaneously at any point along the ion path as a result of excitation received in the ionization process. Fragmentation and scattering can also occur as the result of collisions of the ions with neutral molecules in the flight path or with electrodes and grids. A vacuum in the low $10^{-7}$ torr range is sufficient to effectively limit collisions with neutral molecules, but grids and defining apertures required to achieve resolving power in some cases may reduce sensitivity both due to ion loss and production of ion noise.

In a linear TOF system, fragmentation in the field-free region may produce some tails on the peaks, but generally has at most a small effect on sensitivity or resolving power. The major loss and source of ion noise is fragmentation in the ion accelerator. If acceleration occurs between the end of the drift space and the detector, ghost peaks may occur as the result of low mass charged fragments arriving early and neutral fragments arriving late. No defining apertures or grids are required in the linear analyzer.

In reflecting analyzers, ions that fragment between the source and mirror will appear as broad peaks at an apparent mass below the peak for the actual mass, since the fragments spend less time in the ion mirror. Ions fragmenting in the mirror are randomly distributed in the space between the parent ion and the fragment. Grids are often used in the mirror to improve resolving power; these may cause a significant loss in ion transmission and a source of ion noise.

In MALDI-TOF the most obvious limitation on resolving power and mass accuracy is set by the initial velocity distribution that is at least approximately independent of the mass and charge of the ions. Time lag focusing can be employed to reduce the effect of initial velocity, and the distribution in initial position of the ions may become the limiting factor. Other limits are imposed by trajectory errors and the uncertainty in the measurement of ion flight times.

First order dependence on initial position is given by $$R_{s1}=[(D_v-D_s)/D_e](\delta x/d_1 y) \tag{3}$$

where $D_e$ is the effective length of the analyzer, $\delta x$ is the uncertainty in the initial position, $d_0$ is the length of the first acceleration region of the ion accelerator, y is the ratio of the total ion acceleration potential, V, divided by the potential, $V_1$, applied to the first acceleration region, and $D_v$ and $D_s$ are the effective focal lengths for velocity and space focusing, respectively, and are give by $$D_s=2d_0 y^{3/2} \tag{4}$$

$$D_v=D_s+(2d_0 y)^2/(v_n^*\Delta t) \tag{5}$$

where $D_s$, is the effective distance to the space focus measured relative to the exit from the first acceleration region, $\Delta t$ is the time lag between ion production and application of the accelerating field, and $v_n^*$ is the nominal final velocity of the ion of mass m* focused at $D_v$. $v_n$ is given by $$v_n^*=C_1(V/m^*)^{1/2} \tag{6}$$

The numerical constant $C_1$ is given by $$C_1=(2z_0/m_0)^{1/2}=2\times1.60219\times10^{-19}\ \text{coul}/1.66056\times10^{-27}\ \text{kg}=1.38914\times10^4 \tag{11}$$

For V in volts and m in Da (or m/z) the velocity of an ion is given by $$v=C_1(V/m)^{1/2}\ \text{m/sec} \tag{7}$$

and all lengths are expressed in meters and times in seconds. It is numerically more convenient in many cases to express distances in mm and times in nanoseconds. In these cases $C_1=1.38914\times10^{-2}$.

The time of flight is measured relative to the time that the extraction pulse is applied to the source electrode. The extraction delay $\Delta t$ is the time between application of the laser pulse to the source and the extraction pulse. The measured flight time is relatively insensitive to the magnitude of the extraction delay, but jitter between the laser pulse and the extraction pulse causes a corresponding error in the velocity focus. In cases where $\Delta t$ is small, this can be a significant contribution to the peak width. This contribution due to jitter $\delta j$ is given by $$R_\Delta=2(\delta_j/\Delta t)(\delta v_0/v_n^*)(D_v-D_s)/D_e=2(\delta_j\delta v_0/D_e)[(D_v-D_s)/2d_0 y]^2 \tag{8}$$

and is independent of mass.

The understanding of the profound effect of jitter between the laser and extraction pulse on resolution has not been appreciated in the art until now.

With time lag focusing the first order dependence on initial velocity is given by $$R_{v1}=[(4d_1y)/D_e](\delta v_0/v_n)[1-(m/m^*)^{1/2}]=R_{v1}(0)[1(m/m^*)^{1/2}] \quad (9)$$

where $\delta v_0$ is the width of the velocity distribution. At the focus mass, m=m*, the first order term vanishes. With first order focusing the velocity dependence becomes $$R_{v2}=2[(2d_1y)/(D_v-D_s)]^2(\delta v_0/v_n)^2 \quad (10)$$

And with first and second order velocity focusing the velocity dependence becomes $$R_{v3}=2[(2d_1y)/(D_v-D_s)]^3(\delta v_0/v_n)^3 \quad (11)$$

The dependence on the uncertainty in the time measurement $\delta t$ is given by $$R_t=2\delta t/t=(2\delta C_1/D_e)(V/m)^{1/2} \quad (12)$$

The dependence on trajectory error $\delta L$ is given by $$R_L=2\delta L/D_e \quad (13)$$

A major contribution to $\delta L$ is often the entrance into the channel plates of the detector. If the channels have diameter "d" and angle "a" relative to the ion beam, the mean value of $\delta L$ is d/2 sin $\alpha$. Thus this contribution is $$R_L=d/(D_e \sin \alpha) \quad (14)$$

Noise and ripple on the high voltage supplies can also contribute to peak width. This term is given by $$R_V=\Delta V/V \quad (15)$$

where $\Delta V$ is the variation in V in the frequency range that effects the ion flight time.

It is obvious from these equations that increasing the effective length of the analyzer increases the resolving power, but some of the other effects are less obvious. The total contribution to peak width due to velocity spread with first order velocity focusing is given by $$R_v=R_m+R_{v2} \quad (16)$$

where $\Delta D_{12}$ is the absolute value of the difference between $D_{v1}$ and $D_{v2}$. Assuming that each of the other contributions to peak width is independent, the overall resolving power is given by $$R^{-1}=[R_D^2+R_{s1}^2+R_v^2+R_t^2R_L^2+R_V^2]^{1/2} \quad (17)$$

Optimization of the Linear Analyzer.

The potential diagram for linear TOF is shown in FIG. 3. While this design is superficially similar to previous linear analyzers, it has several unique features. First, the sample plate and extraction electrode are biased at a relatively low positive voltage (ca. 5-8 KV) and a pulsed positive of amplitude 5-2 kV is capacitively coupled to the source plate to produce a total source voltage of 10 kV. A first-field free region is located adjacent to the second acceleration region, and deflection electrodes for correcting for minor misalignments and for gating the ion beam to limit the mass range of transmitted ions are located in this field-free region. The ions are then further accelerated by an additional 30 kV, focused with an einzel lens employing a central electrode nominally at ground potential and travel through a second field-free drift tube (or space) maintained at a potential of −30 kV. A dual channel plate detector is mounted on the end of the drift tube, and bias for the detector is supplied by a voltage divider between −30 kV and ground. The anode is at ground potential and is coupled to the digitizer through a 50 ohm feedthrough. This analyzer is limited to analysis of positive ions.

In this case the important limits are $R_{s1}$, $R_{s1}$, $R_\Delta$, and $R_{v2}$, since second order velocity focusing with a linear analyzer, while possible, corresponds to impractical values of the parameters. If we increase the effective length of the source by decreasing the voltage pulse applied to the MALDI plate and increasing the bias voltage so that the total ion acceleration is constant, then the maximum resolving power at the focused mass can be increased as $R_{s1}$ becomes smaller, but the resolving power decreases rapidly at masses other than the focused mass. This corresponds to increasing the value of the voltage ratio parameter $y=40/(10-V_1)$. The equations for the focal distances are modified slightly by the extra stages in the ion source accelerator. The total effective flight distance $D_e$ corresponds to the length of a field-free region for which the flight time is identical to that through the actual system. For the system illustrated in FIG. 3 this is given by $$D_e=2d_0y^{1/2}[1+(d_1/d_0)/(y^{1/2}+1)]+2d_2+(4/3)(d_3+d_4)+D \quad (18)$$

The effective values of the focal distances $D_s$ and $D_v$ are given by equations (4) and (5). Calculation of effective and focusing distances and resolving power dependences are summarized in Table I as a function of voltage $V_e$ applied to the extraction plate. These calculation correspond to the analyzer configuration shown in FIG. 3 with distances $d_0$=3 mm, $d_1$=3 mm, $d_2$=20 mm, $d_3$=12.5 mm, $d_4$=25 mm, and D=1189 mm. The uncertainties in initial position and initial velocity depend on the choice of MALDI matrix and may depend on the method used for preparing the sample. Under some conditions the estimated uncertainties are $\delta x$=0.01 mm and $\delta v_0$=0.0004 mm/nsec. The results summarized in Table I correspond to first order focus for 6 kDa.

The calculation of $R_\Delta^{-1}$ for $\delta j$=10 nsec in equation (6) corresponds to the value of the jitter between the laser pulse and the extraction pulse determined experimentally. Clearly this is the major limitation on resolving power under essentially all conditions. Reducing this jitter to 1 nsec substantially improves the resolving power and the value of the voltage ratio y can be chosen either to provide adequate resolving power over a broad mass range, e.g. $V_1$=5 kV, or higher resolving power at the focused mass but with a narrower range of focus with larger values of $V_1$. The contribution to the overall time resolution of the detector and digitizer is calculated for a 5 um channel plate with a digitizer employing 0.5 nsec bins, corresponding to a minimum peak width of about 1.5 nsec.

The major effect due to an increase in the length of the analyzer is to decrease the contribution $R_{v1}$ to the peak width, thus reducing the mass dependence of the resolving power. This is accompanied by a decrease in the effect of $R_t$ on peak width, and large decrease in $R_{v2}$, but neither has a significant effect on overall resolving power. A longer drift tube (or space) length requires reducing the laser frequency inversely with the length for constant mass range, or decreasing the mass range inversely with the square of the drift tube (or space) length at constant laser frequency. With the geometry and voltages employed in this instrument the mass range is 0-180 kDa at a laser rate of 5 khz. The overall conclusion is that there is little incentive for employing drift distances much greater than ca. 1 m in a linear analyzer. Also, a slower detector and wider digitizer bins can be used with the linear analyzer when the goal is nearly uniform resolving power over a wide mass range.

TABLE I

Calculated focal distances and resolving powers for linear analyzer.

| | | | | | | | | | $\delta_y$ = 10 nsec | | $\delta_y$ = 1 nsec | |
|---|---|---|---|---|---|---|---|---|---|---|---|---|
| $V_e$ | y | $D_e$ | $D_s$ | $D_v - D_s$ | Δt | $R_{s1}^{-1}$ | $R_{v1}^{-1}$ | $R_t^{-1}$ | $R_\Delta^{-1}$ | $R(m^*)^{-1}$ | $R_\Delta^{-1}$ | $R(m^*)^{-1}$ |
| 5 | 8 | 1300 | 136 | 1164 | 55 | 2680 | 1215 | 12070 | 276 | 274 | 2760 | 1900 |
| 6 | 10 | 1302 | 190 | 1112 | 90 | 3510 | 975 | 12090 | 475 | 470 | 4750 | 2750 |
| 7 | 13.3 | 1305 | 292 | 1013 | 175 | 5150 | 730 | 12115 | 1010 | 988 | 10100 | 4290 |
| 8 | 20 | 1310 | 537 | 773 | 520 | 10170 | 490 | 12160 | 3950 | 3750 | 39500 | 7800 |

Figure 6:
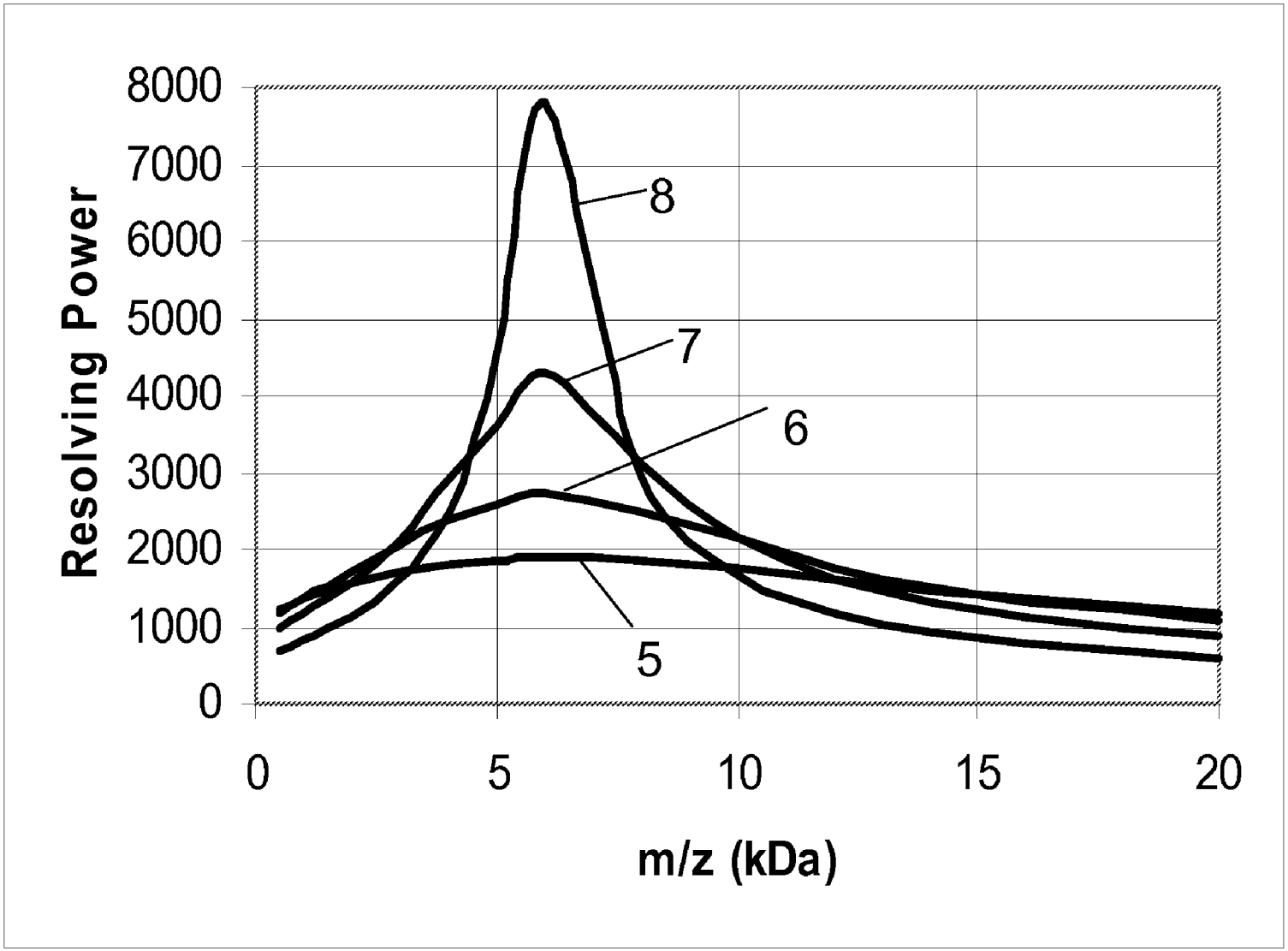
FIG. 6 is a graph of calculated resolving power as a function of mass-to-charge ratio for different operating conditions according to the invention in the range from 0.5 to 20 kDa with a focus mass of 6 kDa. The parameter is the voltage (kV) applied to the extraction electrode.
Figure 7:
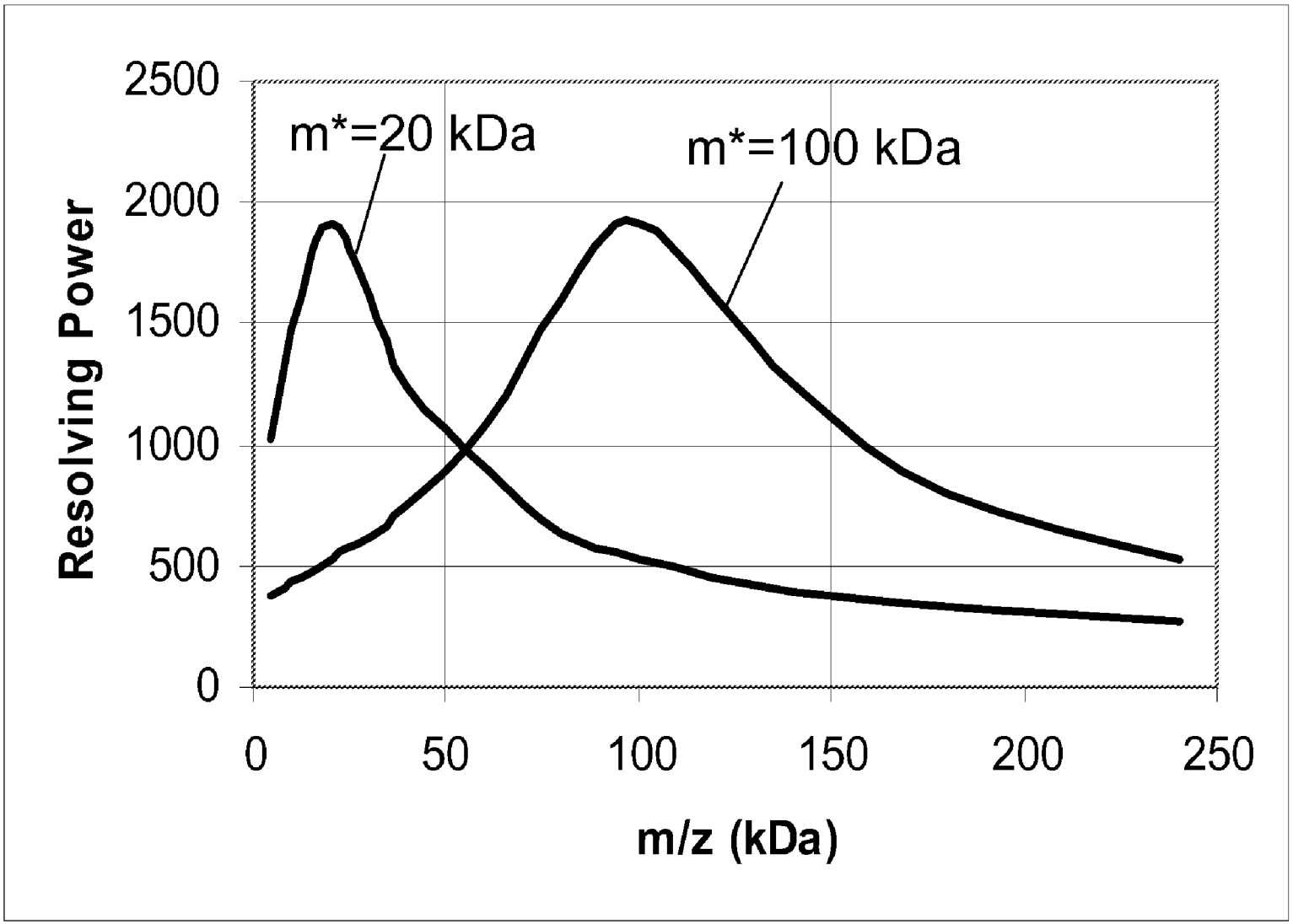
FIG. 7 is a graph of the effect of focus mass on calculated resolving power for one operating condition in the high mass region extending out to 250 kDa for focus masses of 20 kDa and 100 kDa.
Figure 8:
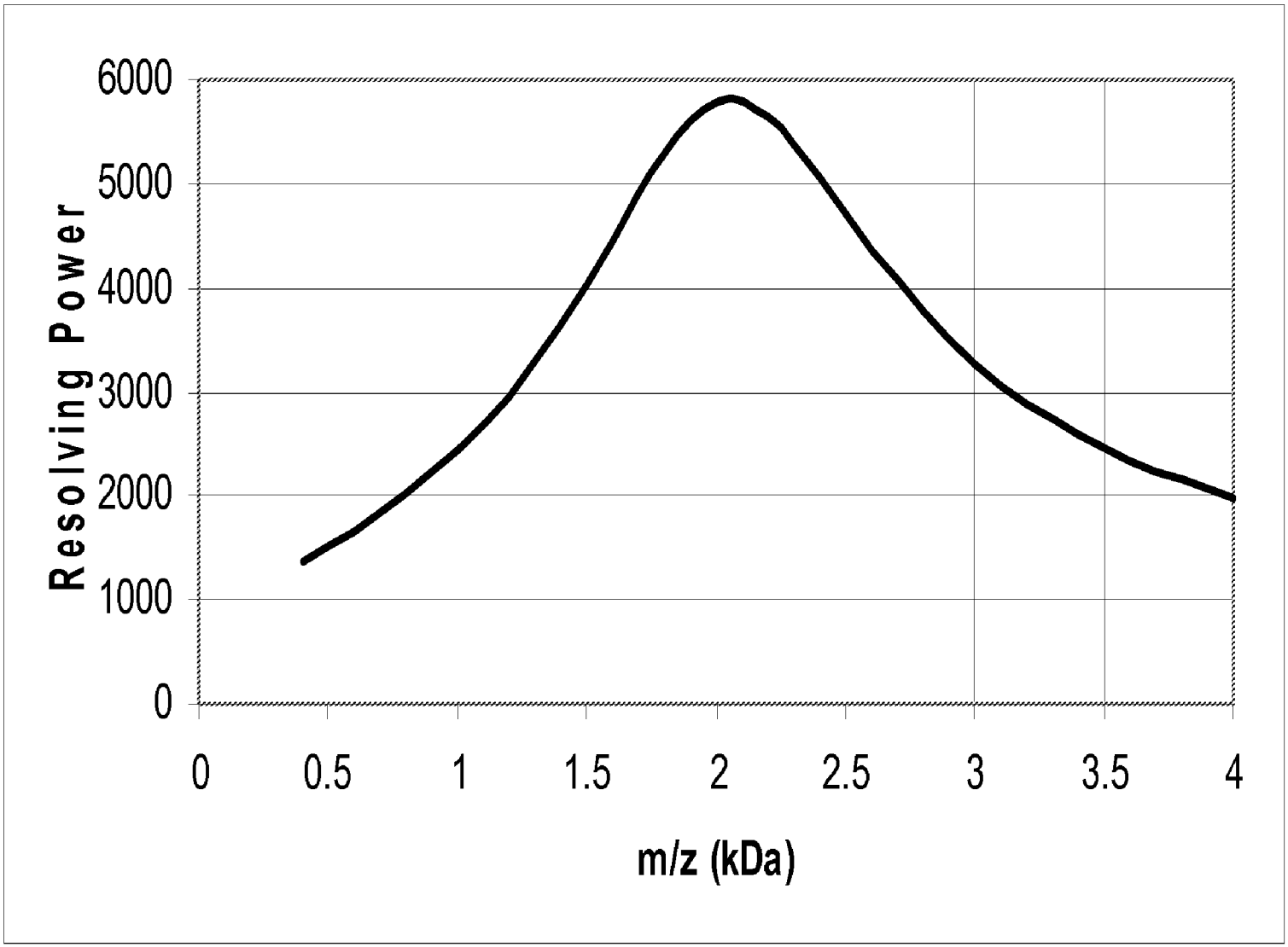
FIG. 8 is a graph of the resolving power as a function of m/z for a focus mass of 2 kDa and extraction voltage of 8 kV.

FIG. 6 shows the results of calculations of resolving power as functions of m/z for the values of the voltage on the extraction electrode, $V_e$ in Table I for a focus mass m* of 6 kDa over a mass range from 0.5 to 20 kDa. These results illustrate the trade-off between resolving power over a broad range of mass versus maximum resolving power at a particular mass. FIG. 7 illustrates the effect of choosing a different focus mass for the case $V_e$=5V in the high mass region extending out to 250 kDa. FIG. 8 shows calculated resolving power with a focus mass of 2 kDa and 8 kV extraction voltage. Isotopic resolution over the range from 0.4 to 3 kDa is indicated. Thus, the linear TOF may also be useful for the analysis of fragile peptides or other small molecules that do not survive transmission through a reflecting analyzer even though the resolving power and mass accuracy for the linear analyzer is inferior to the reflector.

While this invention has been particularly shown and described with references to preferred embodiments thereof, it will be understood by those skilled in the art that various changes in form and details may be made therein without departing from the scope of the invention encompassed by the appended claims.

What is claimed is:

1. A time-of-flight mass spectrometer comprising:

a. a pulsed ion source;

b. a first field-free drift space substantially at ground potential to receive ions from the pulsed ion source;

c. a second field-free drift space isolated from ground potential to receive ions from the first field-free drift space; and d. an ion detector having an input surface in electrical contact with the second field field-free drift space at the end distal from the first field-free drift space and having an output surface at ground potential.

2. The time-of-flight mass spectrometer of claim 1 further comprising:

a. a MALDI sample plate within the pulsed ion source;

b. a pulsed laser beam directed to strike the MALDI sample plate and produce a pulse of ions;

c. a high voltage pulse generator operably connected to the pulsed ion source;

d. a time delay generator providing a predetermined time delay between the laser pulse and the high voltage pulse; and e. a high voltage supply providing substantially constant voltage to the second field-free drift space of opposite polarity to that of the high voltage pulse generator.

3. The time-of-flight mass spectrometer of claim 2 having a predetermined time delay comprising an uncertainty of not more than 1 nanosecond.

4. The time-of-flight mass spectrometer of claim 2, wherein the amplitude of the high voltage pulse is 10 kilovolts positive relative to ground potential and the high voltage supplied to the second field-free drift space is 30 kilovolts negative relative to ground potential.

5. The time-of-flight mass spectrometer of claim 2, wherein the amplitude of the high voltage pulse is 10 kilovolts negative relative to ground potential and the high voltage supplied to the second field-free drift space is 30 kilovolts positive relative to ground potential.

6. The time-of-flight mass spectrometer of claim 1, wherein the detector comprises an input surface that produces secondary ions and an electron multiplier at substantially ground potential that detects secondary ions after acceleration from the second field-free drift space.

7. The time-of-flight mass spectrometer of claim 4, wherein the detector comprises a dual channel plate assembly with an input surface in electrical contact with the second field-free drift space and an anode at ground potential.

8. The time-of-flight mass spectrometer of claim 7, wherein the potential difference across the channel plate assembly is provided by a voltage divider between the potential applied to the second field-free drift space and ground.

9. The time-of-flight mass spectrometer of claim 7, wherein the potential difference across the channel plate assembly is controlled by adjusting the resistance of the portion of the voltage divider near the grounded terminal.

10. The time-of-flight mass spectrometer of claim 2 further comprising an extraction electrode located adjacent to the MALDI sample plate said extraction electrode having a predetermined constant voltage which is applied to an extraction plate and the MALDI sample plate.

11. The time-of-flight mass spectrometer of claim 10, wherein the high voltage pulse is capacitively coupled to either the MALDI sample plate or the extraction plate to accelerate ions of a predetermined polarity.

12. The time-of-flight mass spectrometer of claim 1, wherein the pulsed ion source operates at a frequency of 5 khz.

13. A time-of-flight mass spectrometer comprising:

a. an ion source vacuum housing configured to receive a MALDI sample plate;

b. a pulsed ion source located within the ion source housing;

c. an analyzer vacuum housing;

d. a gate valve located between and operably connecting said ion source vacuum housing and said analyzer vacuum housing and maintained at or near ground potential;

e. a first field-free drift tube at or near ground potential located within said ion source vacuum housing to receive an ion beam from said pulsed ion source;

f. a second field-free drift tube located within said analyzer vacuum housing but electrically isolated from said housing to receive an ion beam from said first field-free drift tube; and g. an ion detector having an input surface in electrical contact with the second field field-free drift space at the end distal from the second ion mirror and having an output surface at ground potential.

14. The time-of-flight mass spectrometer of claim 13 further comprising one or more pairs of deflection electrodes located in the field-free region at ground potential adjacent to the gate valve with any pair energized to deflect ions in either of two orthogonal directions.

15. The time-of-flight mass spectrometer of claim 14, wherein at least one of the deflection electrodes of any pair of deflection electrodes is energized by a time-dependent voltage resulting in the deflection of ions in one or more selected mass ranges.

16. The time-of-flight mass spectrometer of claim 13 further comprising one or more ion lenses for spatially focusing the ion beam.

17. The time-of-flight mass spectrometer of claim 16, wherein said one or more ion lenses comprise:

a. a first ion lens located between the pulsed ion source and the gate valve; and b. a second ion lens located between the gate valve and the second field-free drift tube.

18. The time-of-flight mass spectrometer of claim 17, wherein each of the ion lenses comprise either an einzel lens or a cathode lens.

* * * * *